United States Patent [19]

Stauft

[11] 4,374,519

[45] Feb. 22, 1983

[54] SPINAL MASSAGE DEVICE

[76] Inventor: Amos K. Stauft, 23869 Van Born Rd., Taylor, Mich. 48180

[21] Appl. No.: 207,122

[22] Filed: Nov. 17, 1980

[51] Int. Cl.[3] ..... A61H 15/00

[52] U.S. Cl. ..... 128/57; 272/127

[58] Field of Search ..... 128/57, 33; 272/127; 46/201, 221

[56] References Cited

U.S. PATENT DOCUMENTS 2,619,957 12/1952 Hague ..... 128/57

2,633,844 4/1953 Herndon ..... 128/57

2,661,573 12/1953 Onley, Jr. ..... 46/201

FOREIGN PATENT DOCUMENTS 147152 7/1952 Australia ..... 42/201

*Primary Examiner*—Richard C. Pinkham

*Assistant Examiner*—T. Brown

*Attorney, Agent, or Firm*—Charles W. Chandler

[57] ABSTRACT

A spinal massage device comprising four rubber balls mounted in pairs on opposite sides of a linking plate such that the balls are rotated along a supporting surface, such as the floor, as the user lies with his spine on the device and then moves his back parallel to the floor.

4 Claims, 4 Drawing Figures

SPINAL MASSAGE DEVICE

BACKGROUND OF THE INVENTION

This invention is related to spinal massage devices of the type in which the user rests his back on the device and then advances his spine such that the device progressively engages his spinal column, and more particularly to such a device comprising four rubber balls mounted on a linking plate to conform to the curvature of the user's spine as he advances his spine along the device.

Spinal massage devices have been disclosed in the prior art in which the device is mounted on a supporting surface, such as a floor. The user then manipulates his spinal column by laying, back down, on the device and then advancing his spine along the device. One such device was disclosed in the prior art in U.S. Pat. No. 2,619,957 which issued Dec. 2, 1952 to C. W. Hague. The Hague device employs a series of tubular tires supported in pairs on a shaft. However, there is no provision for allowing the shaft of one pair of tires to move toward the shaft of another pair to accomodate variances in the user's spinal dimensions, such as exists in a person having a curved spine and the like.

SUMMARY OF THE INVENTION

The broad purpose of the present invention is to provide an improved spinal device comprising four rubber balls mounted in pairs on opposite sides of a linking plate in such a manner that the balls on each side of the plate can be moved either toward or away from one another as all four balls are being rotated by the user with his spine in contact with the balls.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
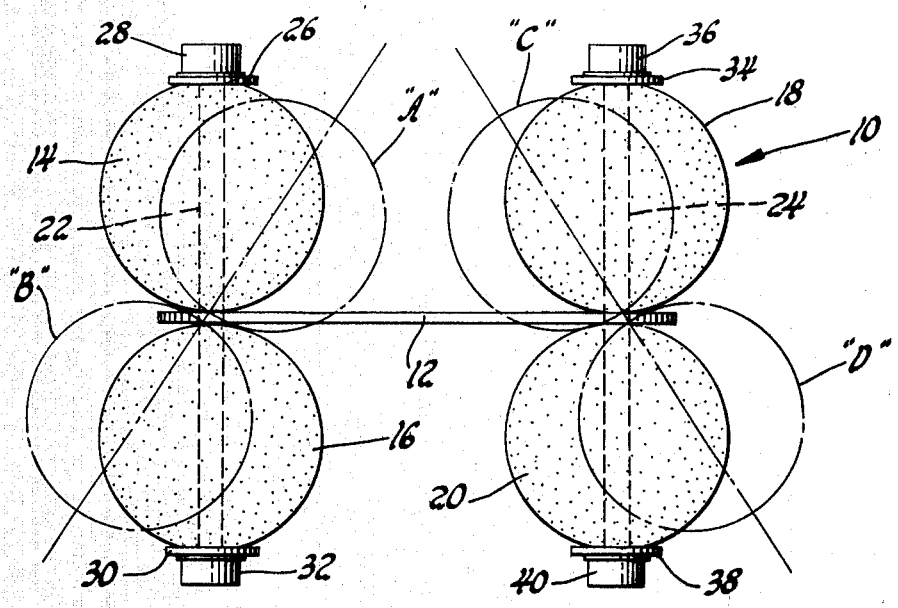
FIG. 1 is a plan view of a preferred spinal massage device.
Figure 2:
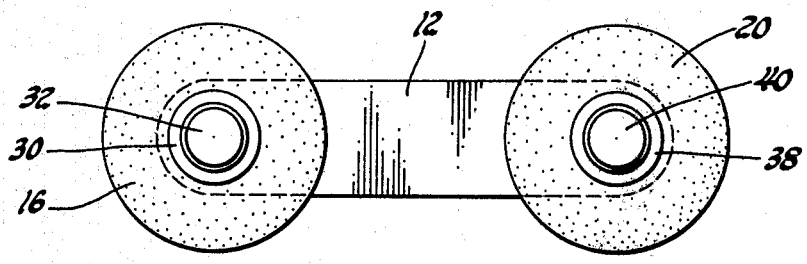
FIG. 2 is an elevational view of the preferred device.

Referring to the drawing, FIG. 1 illustrates a preferred spinal massage device 10 comprising a linking plate 12 and four resilient rubber balls 14, 16, 18, and 20.

A shaft 22 supports balls 14 and 16, and a shaft 24 supports balls 18 and 20. The balls are each formed with a bore having a diameter slightly smaller than the diameter of their respective shafts so that when the shafts are inserted in the balls, the balls frictionally engage the shaft in such a manner that each pair of balls rotates with its respective shaft, however, the frictional engagement is such that the balls on each shaft can be rotated with respect to one another.

A washer 26 and cap 28 are mounted on the end of shaft 22, and a washer 30 and cap 32 are mounted on the opposite end of shaft 22. Similarly, a washer 34 and cap 36 are mounted on one end of washer shaft 24 and a washer 38 and cap 40 are mounted on the opposite end of shaft 24. Each cap and washer is mounted on the end of its shaft in such a manner that it slightly compresses its respective ball between the washer and the linking plate so that there is a slight resistance to rotation of each pair of balls and its respective shaft.

Figure 3:
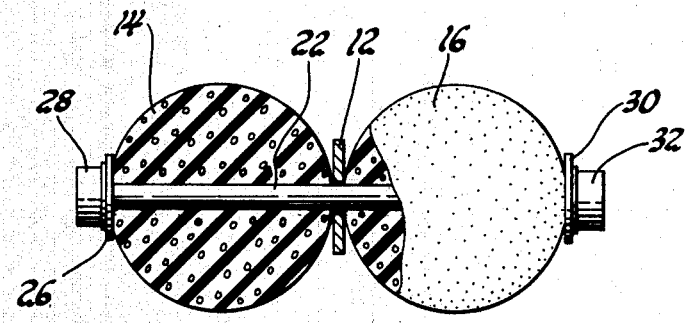
FIG. 3 is an end view of the device with parts of the balls being illustrated in section.

Referring to FIGS. 1 and 3, the relationship between the thickness of the linking plate and the diameter of the hole in the plate for receiving shaft 22 is such that the shaft can be tilted with respect to the plate so that ball 14 is moved to a position illustrated in phantom at "A" and ball 16 is moved to a position illustrated at "B".

Similarly, shaft 24 is mounted on the linking plate in such a manner that ball 18 can be moved to a position illustrated in phantom at "C" as ball 20 is moved to a position illustrated at "D". Thus as the balls on one side of the plate are moved toward one another, the balls on the opposite side of the plate are moved away from one another. Similarly, balls 16 and 20 can be moved away from one another as the balls on the opposite side are moved away from one another, as both balls are being rotated with respect to the shaft.

The reason for this arrangement is to allow the balls to assume positions compatible with the curvature of the user's spine.

Figure 4:
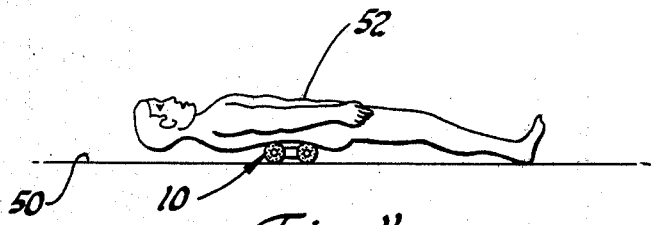
FIG. 4 is a schematic diagram illustrating the manner in which the user uses the device to massage his spine.

FIG. 4 illustrates the manner in which the device is mounted on floor 50 with a user 52 laying with his spine on device 10. He then advances his spine moving his body along the floor so that the balls tend to progressively adjust the joints of the spine.

Preferably the balls are each about two and a half inches in diameter with a distance of four inches between the balls at such time as the two shafts 22 and 24 are parallel to one another.

Having described my invention, I claim:

1. A spinal massage device comprising:

an elongated linking plate having a first end and a second end;

a first resilient member and a second resilient member mounted on opposite faces of the first end of the linking plate, and means connecting the first resilient member and the second resilient member such that they are disposed to be rotated together as well as with respect to one another;

a third resilient member and a fourth resilient member mounted adjacent opposite faces of the second end of the linking plate, and means connecting the third resilient and the fourth resilient member such that they are disposed to be rotated together, as well as with respect to one another;

the first resilient member and the third resilient member being mounted on the same side of the linking plate so as to be movable toward one another as the second resilient member and the fourth resilient member are moved away from one another; and said first, second, third, and fourth resilient members each comprise resilient balls of equal diameter and in which the linking plate has a width less than the diameter of said balls whereby the user can roll his spine on the balls as they are rolled along a supporting surface.

2. A combination as defined in claim 1, in which the means connecting the first resilient and the second resilient member comprise a shaft, and said resilient members are mounted on opposite ends of said shaft, the shaft being mounted through an opening in the linking plate so as to be tiltable with respect to the plate.

3. A combination as defined in claim 1, in which the said first, second, third, and fourth resilient members comprises four balls of equal diameter, and in which the diameter of the balls is about two and a half inches, all of the balls are in contact with their respective faces of the linking plate.

4. A combination as defined in claim 1, in which the resilient members comprise four balls of equal diameter, the balls on each side of the linking plate being about four inches apart from center to center of the balls at such times as the balls on one side of the plate are the same distance apart as the balls on the opposite side thereof.

* * * * *